US008674277B2

(12) United States Patent
Axford et al.

(10) Patent No.: US 8,674,277 B2
(45) Date of Patent: Mar. 18, 2014

(54) GUIDANCE DEVICE

(75) Inventors: Richard Desmond Joseph Axford, Berkshire (GB); Kevin William Beggs, Lancashire (GB)

(73) Assignee: BAE SYSTEMS plc, London (GB)

( * ) Notice: Subject to any disclaimer, the term of this patent is extended or adjusted under 35 U.S.C. 154(b) by 131 days.

(21) Appl. No.: 13/508,633

(22) PCT Filed: Nov. 11, 2010

(86) PCT No.: PCT/GB2010/051879

§ 371 (c)(1),
(2), (4) Date: May 8, 2012

(87) PCT Pub. No.: WO2011/058359

PCT Pub. Date: May 19, 2011

(65) Prior Publication Data

US 2012/0223180 A1 Sep. 6, 2012

(30) Foreign Application Priority Data

Nov. 13, 2009 (EP) ..... 09252614
Nov. 13, 2009 (GB) ..... 0919965.4

(51) Int. Cl.
*F42B 10/14* (2006.01)
*F42B 10/62* (2006.01)
*F42B 10/00* (2006.01)

(52) U.S. Cl.
USPC ..... 244/3.21; 244/3.1; 244/3.15; 244/3.24; 89/1.1; 89/1.11; 102/501

(58) Field of Classification Search
USPC ..... 244/3.1–3.3; 42/76.01, 79; 102/501, 102/517, 524, 526, 527; 89/14.05, 14.3, 89/1.1, 1.11
See application file for complete search history.

(56) References Cited

U.S. PATENT DOCUMENTS 1,294,604 A 2/1919 Berentsen
1,327,545 A * 1/1920 Garnier ..... 244/3.24

(Continued)

FOREIGN PATENT DOCUMENTS

DE 245 032 3/1912
EP 0 441 670 A1 8/1991

(Continued)

OTHER PUBLICATIONS

International Search Report dated Feb. 28, 2011 issued in PCT/GB2010/051879.

(Continued)

*Primary Examiner* — Bernarr Gregory
(74) *Attorney, Agent, or Firm* — Scully, Scott, Murphy & Presser, PC

(57) ABSTRACT

There is disclosed a collar (100) which may be attached to a munition in order to control the trajectory of the munition. The collar (100) has a collar body (10); a surface (12) for capturing the projectile as it leaves the barrel; a sill (14) for supporting the surface (12) at the muzzle of the barrel; and a guidance means (20*a*, 20*b*, 21*a*, 21*b*) for altering the flow of air around the collar (100). The collar (100) supports itself at the muzzle and may attach to the projectile at the surface (12) to integrate with the projectile as the projectile is fired. The collar (100) is particularly suited for attachment to mortar rounds. Such a collar (100) gives a weapon operator the option of increasing the precision of a munition without having to carry a plurality of munition types.

14 Claims, 5 Drawing Sheets

(56) References Cited

U.S. PATENT DOCUMENTS

| | | | | |
|---|---|---|---|---|
| 3,179,052 | A | 4/1965 | Jasse | |
| 3,457,862 | A * | 7/1969 | Mardarello et al. | 244/3.28 |
| 3,951,039 | A * | 4/1976 | Manninen et al. | 89/14.3 |
| 4,158,447 | A * | 6/1979 | Humphries et al. | 244/3.27 |
| 4,351,223 | A * | 9/1982 | Schmidt | 89/14.05 |
| 4,565,340 | A * | 1/1986 | Bains | 244/3.28 |
| 4,708,304 | A | 11/1987 | Wedertz et al. | |
| 4,713,904 | A * | 12/1987 | Anderson et al. | 42/79 |
| 4,844,380 | A * | 7/1989 | Peoples et al. | 244/3.22 |
| 5,048,772 | A | 9/1991 | Wisshaupt | |
| 5,762,291 | A * | 6/1998 | Hollis et al. | 244/3.24 |
| 6,254,031 | B1 * | 7/2001 | Mayersak | 244/3.22 |
| 6,453,821 | B1 * | 9/2002 | Fowler et al. | 102/527 |
| 6,764,042 | B2 * | 7/2004 | Moore et al. | 244/3.28 |
| 6,978,967 | B1 * | 12/2005 | Scheper et al. | 244/3.24 |
| 7,004,424 | B1 * | 2/2006 | Pacchia | 244/3.27 |
| 7,004,425 | B2 * | 2/2006 | Okada et al. | 244/3.29 |

FOREIGN PATENT DOCUMENTS

| | | |
|---|---|---|
| EP | 1 953 494 A1 | 8/2008 |
| FR | 619 481 | 4/1927 |
| GB | 104382 | 3/1917 |
| JP | 6-26799 | 2/1994 |
| WO | WO 2009/132134 A1 | 10/2009 |

OTHER PUBLICATIONS

Extended European Search Report dated Jul. 28, 2010 issued in EP 09252614.4.

UK Search Report dated Jun. 14, 2010 issued in GB 0919965.4.

International Preliminary Report on Patentability and Written Opinion, dated May 24, 2012 from related International Application No. PCT/GB2010/051879.

* cited by examiner

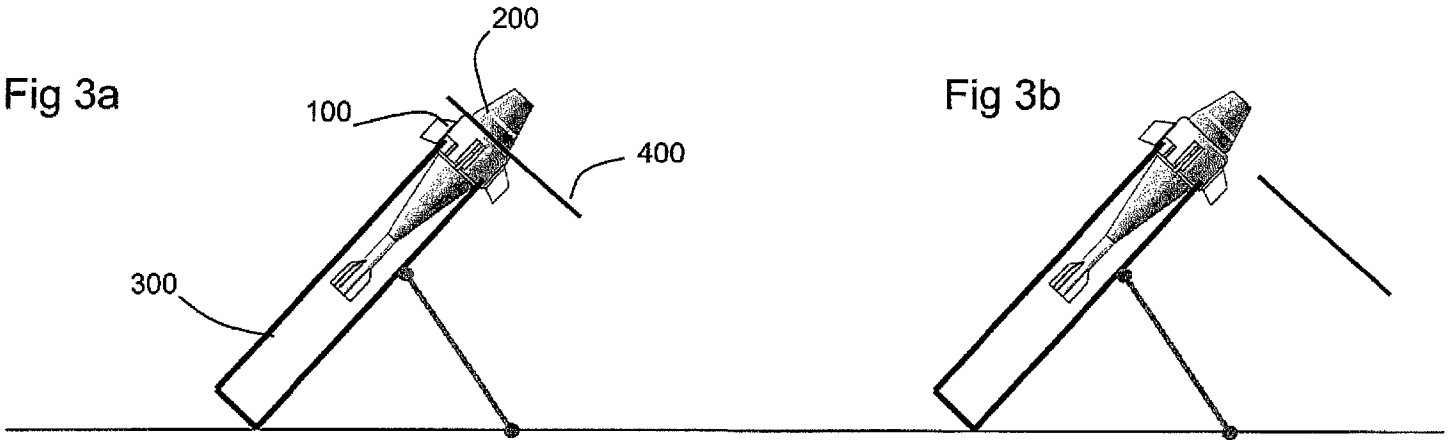
Fig 3a
Fig 3b
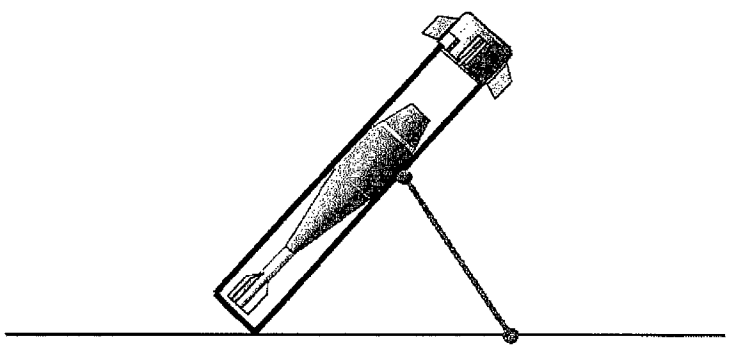
Fig 3c
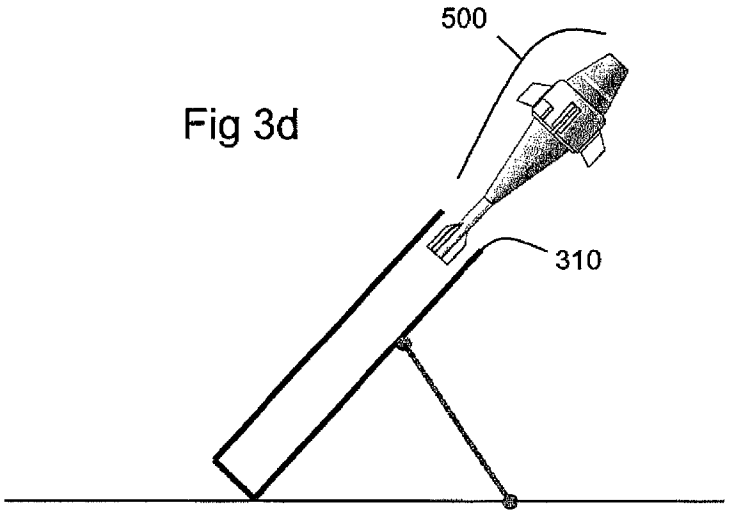
Fig 3d

GUIDANCE DEVICE

The present invention relates to a guidance device comprising a collar for guiding a projectile, and in particular to a collar for improving the precision of a ballistic projectile.

BACKGROUND OF THE INVENTION

In the field of ballistics, the term precision describes the ability of a projectile, fired from a weapon system, to follow a predicted trajectory and hence hit an expected target; a precise projectile will, by definition, follow a predicted trajectory more closely than an imprecise projectile. Ballistic precision is commonly measured using the circular error probability (CEP).

In most cases, it is desirable to have a precise projectile. However, the unit cost of a projectile tends to rise with increased precision. Accordingly, it is generally understood that in designing projectiles, the benefit of providing a particularly precise projectile must be balanced against the costs of such provision.

It is known to have a kit, such as the XM1156 Precision Guidance Kit (as may be supplied by Alliant Techsystems to the US Army), whereby a standard (i.e. non-guided) 155 mm artillery shell may be converted into a guided munition. The kit comprises means for controlling the trajectory of the projectile. Such controlling means may include a set of control surfaces, a processor, and an actuator for moving the control surfaces in response to a correcting signal from the processor. The processor may be interfaced with Global Positioning System (GPS) and Inertial Navigation (IN) sensors to determine the correcting signal which is to be applied.

The kit, which further includes a fuze, can be retrofitted into a shell by detaching the fuze section of the shell from the body section of the shell and then attaching the kit to the body section. The kit may therefore give users the option of converting munitions and thus selecting the precision of each round fired.

However, the Precision Guidance Kit (PGK) may have a deep intrusion body that necessitates the removal of some of the shell's explosive payload in order to fit the PGK instead of the original fuze.

Further, the act of replacing the original fuze with the kit may be undesirably time consuming, particularly given the urgency with which a muniton may need to be fired. Indeed, it may not even be possible to replace the original fuse with the kit on the battlefield, for example if some of the payload must be removed as described above.

Further, the kit may only be applicable to munitions which have a detachable fuze. Where the munition does not originally have a fuze, the kit cannot readily be applied.

SUMMARY OF THE INVENTION

It is an object of the present invention to provide a collar for guiding a projectile which mitigates at least one of the disadvantages of the prior art identified above.

The present invention provides a guidance device for guiding the trajectory of a projectile during flight, the device comprising: a collar having a collar body configured to be located at a muzzle of a projectile barrel prior to launch and having an internal profile which cooperates with an outer surface of the projectile when the projectile is launched through the muzzle so that the collar is attached to the projectile during flight; the collar having guidance means comprising at least one adjustable control surface for controlling the trajectory of the projectile during flight, adjustment of said control surface being responsive to guidance signals received from a guidance control.

The internal profile of the collar may be configured to engage with a rim of the projectile barrel so that the collar is located in position to cooperate with the projectile on launch.

Said at least one guidance surface may be pivotally mounted to the collar to allow adjustment of said surface relative to the collar.

An actuator may adjust the control surface in response to said guidance signals.

The guidance control may comprise at least one sensor for sensing a trajectory of the projectile during flight, and a processor for comparing the sensed trajectory with a predicted trajectory and outputting guidance signals for correcting the trajectory of the projectile so that it corresponds with the predicted trajectory. The guidance control may comprise a memory for a storing the predicted trajectory of the projectile. The at least one sensor may be configured for determining the trajectory of the projectile during an initial period after launch and outputting said determined trajectory for storing by the memory as the predicted trajectory.

The present invention also provides a collar for guiding a projectile, the collar comprising a collar body, a surface for capturing the projectile as it leaves the barrel, a sill for supporting the surface at the muzzle of the barrel, and a guidance means for altering the flow of air around the collar, wherein the collar may attach to the projectile at the surface to integrate with the projectile as the projectile is fired.

Such a collar can be transported into battlefield with the munitions and the weapon system to offer a more precise firing should this be desired. The collar is simple to mount on the muzzle and does not require the detachment or reattachment of munition components prior to firing.

A further benefit when compared to guidance kits that require replacement of parts is that the use of the above collar will tend to minimise the number of components which must be transported after a set of precise firings. Thus this invention is in contrast to a system where fuzes may be replaced in the field because in that situation, the replacements must be brought into the field and the replaced fuzes brought back.

The law of the conservation of momentum dictates that as the mortar integrates with the collar, the velocity of the mortar will drop on account of the mass of the collar. It follows that the range of the integrated projectile will be less than that of an equivalent projectile. However, it is expected that in many situations, the benefits of a precise projectile compensate for the reduction in maximum range. It is nonetheless advantageous to minimise the mass of the collar wherever possible.

The collar may comprise a control surface, an actuator for altering the configuration of the control surface, and a guidance controller, the guidance controller comprising a navigation sensor for determining an actual trajectory the projectile is following, a memory at which data describing a predicted trajectory is stored, a processor operably connected to the actuator, the memory and the navigational sensor, wherein the processor calculates a correction signal which determines how the configuration of the control surface may be altered and transmits the correction signal to the actuator.

In particular the processor may calculate the correction signal by determining the difference (which may alternatively be referred to as the error or the deviation) between the actual trajectory and the predicted trajectory.

At the collar, the control surface may comprise a pair of canards, each canard comprising a pivot joint connecting the canard to the collar and wherein the actuator may be a ring actuator which connects to the canards so as to be able to alter the configuration of the control surface by rotating the canards about their pivots.

Where a pivot joint connects each of the canards to the collar body, the pivot joint is preferably connected forwards of the centre of pressure of the canard.

Where the ring actuator may correct the projectile course by applying a force to the control surface so as to move the control surface out of alignment with the air stream over the projectile body, such a location of the pivot leads to a stable control arrangement. This stability is conferred because as the actuator ceases to apply the force to the control surface, the air flow will return the control surface to its original configuration.

Such a position of the pivot should therefore also tend to simplify the control signals (i.e. the correction signal) which needs to be sent to the actuator because little consideration needs to be given to how the actuator must move in order to return the control surface to its original position; the correcting signal can consist of a set of identical signals, which rise in repetition frequency with the projectile deviation but need not be transmitted if the projectile follows the predicted trajectory.

By 'forwards', the reader will understand that this means that the pivot is mounted more towards the leading edge of the collar, i.e. further towards the oncoming air stream.

Further, each canard may be connected to the ring actuator at a point on the canard towards or at the trailing edge of the canard.

By thus positioning the interface between the actuator and the control surface, it tends to facilitate the best mechanical advantage and thus enables the weakest/lightest ring actuators to be used.

At the collar, the surface for capturing may be at an internal facet of the collar and may have a tapered inner diameter, operable to form an interference fit with said projectile, and thereby allow the collar to attach to the projectile.

Preferably, where the surface is to capture the projectile by way of an interference fit, the surface and the material providing the surface is capable of elastic deformation. Metals would be suitable materials for the material providing the surface.

In particular, the surface for capturing may define a generally frustoconical form.

As such the sill may support the frustoconical form defined by the surface at the barrel so that the axis defined by the frustoconical form is generally collinear with the axis defined by the barrel.

This supporting arrangement can promote an even interference fit around the projectile and so enable the collar to attach to the projectile and create a symmetrical integrated projectile. Such a symmetrical integrated projectile can be expected to have improved aerodynamic properties and tend to require less guidance.

Such a surface for capturing may be tapered at between 3° and 0.5°, and in particular may be tapered at approximately 1.2°.

The collar may comprise an air escape vent.

Such a provision allows the air exhausted from the barrel prior to the exit of the projectile to escape without disturbing the supported collar.

The collar may be formed as one or more portions operable to be fastened together.

A collar thus formed allows for transportation in a distributed and potentially less bulky form.

According to a further aspect of the invention there is provided a method of attaching a guidance collar to a projectile, the method comprising the steps of a) supporting a collar according to any one of the preceding claims at the muzzle of a barrel loaded with the projectile, b) firing the projectile from the barrel.

BRIEF DESCRIPTION OF THE DRAWINGS

So that the invention may be well understood, an exemplary embodiment of the invention will now be described with reference to the following figures of which:

FIGS. 3*a*, 3*b*, 3*c* and 3*d* show the sequential firing of a mortar operating in conjunction with the collar of FIG. 1*a;*

DETAILED DESCRIPTION OF THE INVENTION

Figure 1A:
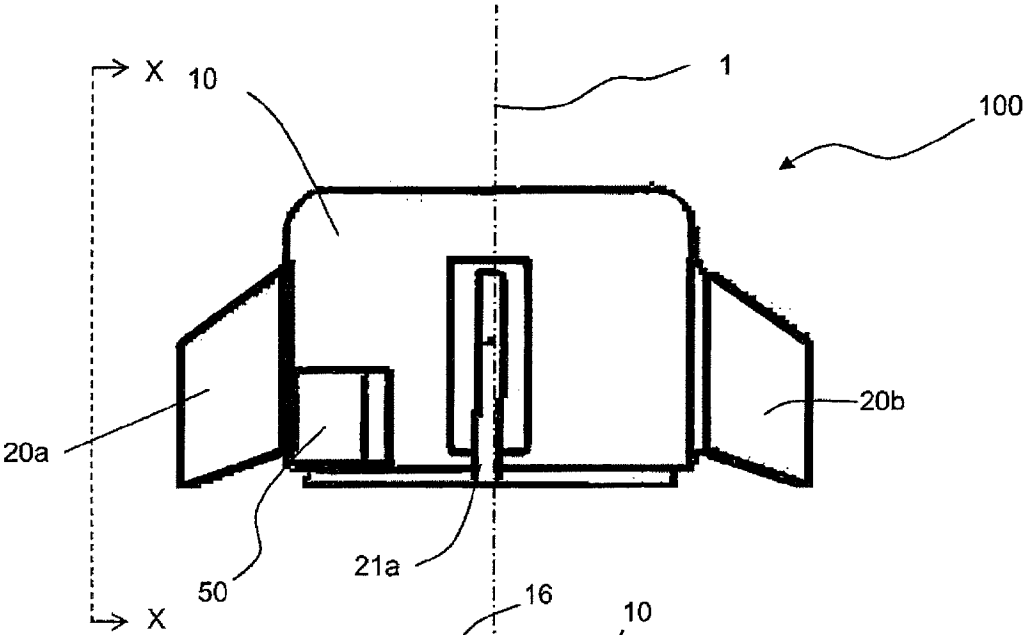
FIG. 1*a* shows a first aspect of a collar according to the present invention.
Figure 1B:
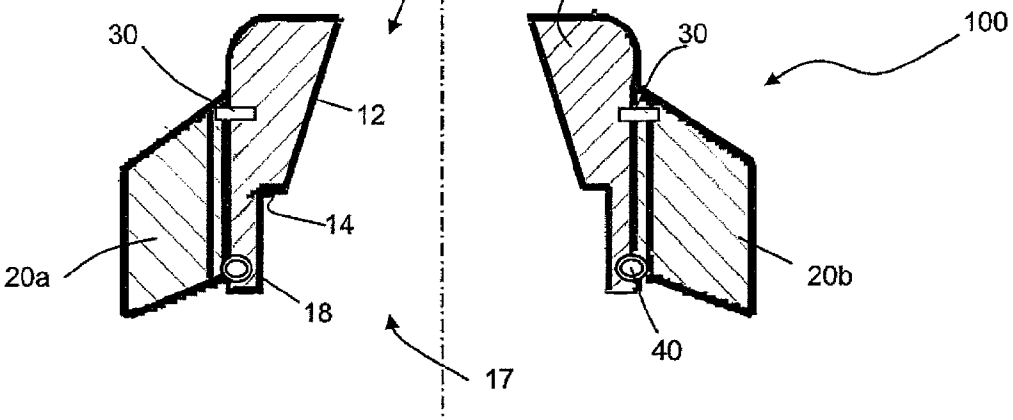
FIG. 1*b* shows a cross section at X-X of the first aspect of the collar of FIG. 1*a;*
Figure 5:
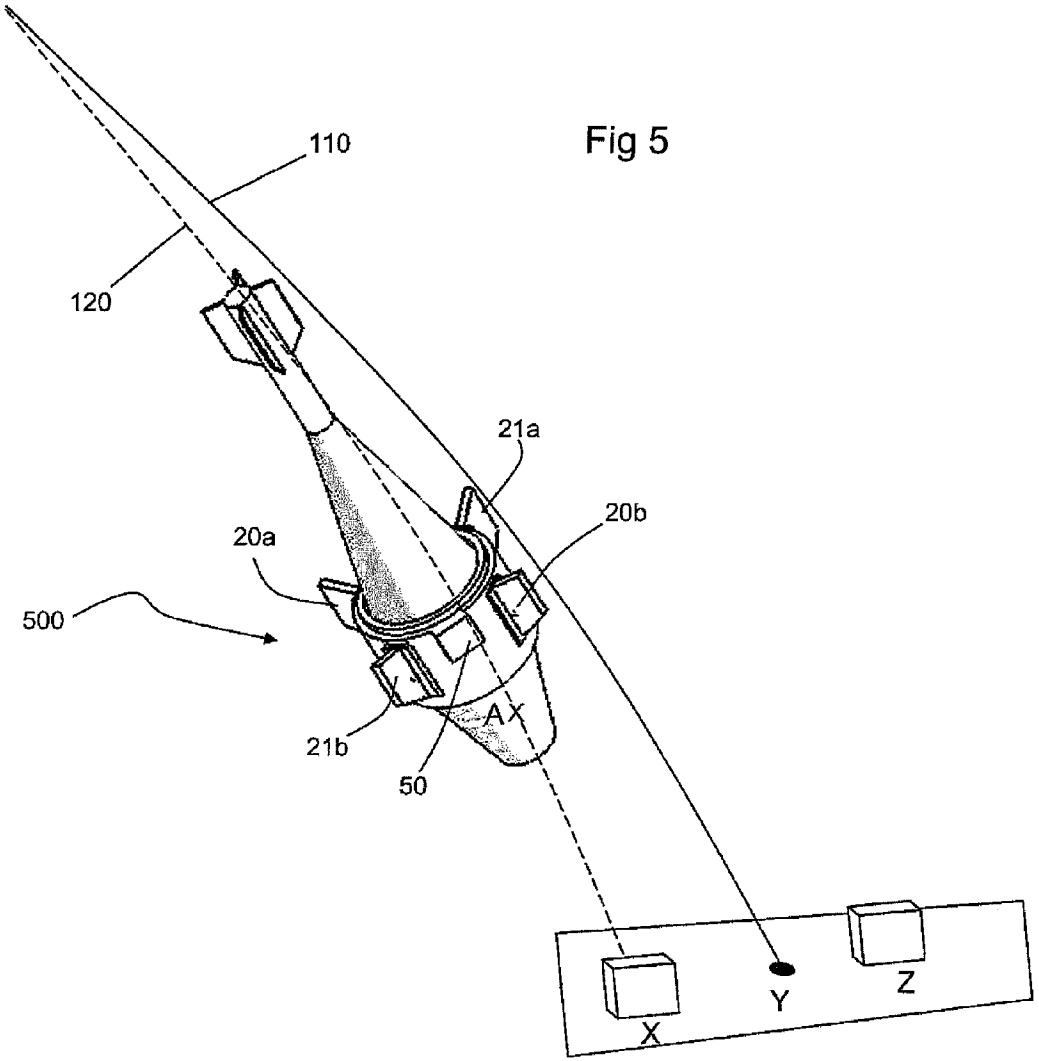
FIG. 5 shows an isometric aspect of the collar of FIG. 1*a*, integrated with the mortar and at Point A of FIG. 4.

A collar 100 for guiding a mortar shell, as shown for example in FIG. 1*a*, FIG. 1*b* and FIG. 5, comprises a collar body 10. The collar body 10 defines a generally cylindrical outer surface, which defines a collar axis 1. The leading edge of the collar (that is the top edge in FIG. 1*a*) is filleted so as to have appropriate aerodynamic properties.

A plurality of canards 20*a*, 20*b*, 21*a* and 21*b* extend from the outer surface of the collar body 10. The plurality of canards 20*a*, 20*b*, 21*a* and 21*b* are spaced at regular intervals about the outer surface of the collar body 10. The canards are arranged in pairs. A first canard pair, consisting of canard 20*a* and 20*b*, generally occupies a first plane with canards 20*a* and 20*b* mounted on diametrically opposite sides of the collar body 10. A second canard pair, consisting of canard 21*a* and 21*b*, generally occupies a second plane with canards 21*a* and 21*b* mounted on diametrically opposite sides of the collar body 10

Each canard is pivotally attached to the collar body 10 by a pivot joint 30 which defines a rotational axis extending normal to the outer surface of the body 10. The canards are arranged to be able to align with the collar axis 1 but deflect from this arrangement as they rotate about the joints 30. Each pivot joint 30 is mounted towards the leading edge of the canard and so is forward of any component of the centre of pressure which may act laterally on the canard.

The collar 100 is hollow and is open towards both ends of its axis 1 to define a conduit. A first opening 16 of the conduit (alternatively referred to as the escape vent 16) is located at the leading edge of the collar 100 and defines a generally circular aperture, normal to the collar axis 10 and with a centre point which lies generally on the collar axis 1. A second opening 17 is located at the trailing edge of the collar 100. The second opening 17 defines a circular aperture normal to the collar axis 10 and with a centre point which lies generally on the collar axis 1.

An inner wall of the collar 100, which comprises a capture surface 12, a sill 14 and a cylindrical section 18, extends between the first opening 16 and the second opening 17.

The capture surface 12 starts at the first opening 16 and extends down into the collar body 10 up to approximately the mid point of the body length. As the capture surface 12 extends away from the leading edge of the collar it tapers out, thereby defining a generally frustoconical surface, and eventually meets the sill 14. The sill 14 is an annular surface normal to the collar axis 1 and with its centre point generally on the collar axis 1. The inner diameter of the annular sill 14 meets the frustoconical surface 12 and the outer diameter of the annular sill 14 meets the cylindrical surface 18. The cylindrical section 18 extends downwards to the second opening 17. The diameter of the second opening 17 is generally identical to the outer diameter of the annular sill 14.

A set of ring actuators 40 is disposed in the collar body 10 and there are connections to each of the canards 20*a*, 20*b*, 21*a* and 21*b*. Each canard is connected to the ring actuator towards the trailing edge of the canard.

Figure 2:
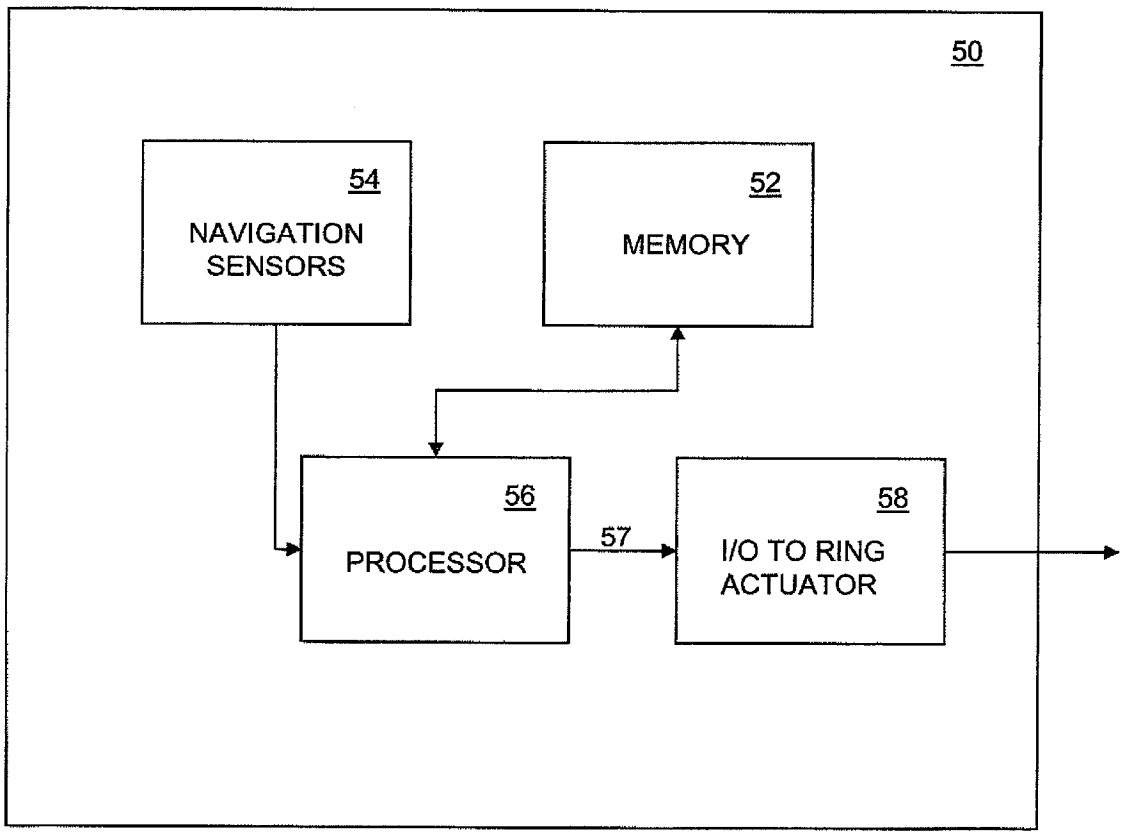
FIG. 2 shows a schematic diagram of the guidance controller for use in the collar of FIG. 1*a;*

Embedded in the collar 100 is a guidance controller 50 which, as can be seen from FIG. 2, comprises a navigation sensor unit 54, a memory 52, a processor 56 and a ring actuator I/O unit 58. Guidance controller 50 is also provided with a power source (not shown).

The processor 56 is operably and independently connected to the sensor unit 54 and the memory 52 and generates as an output a correction signal 57 that is input to the I/O unit 58. The I/O unit is operably connected to the ring actuator 40.

The sensor unit 54 comprises an inertial navigation system (comprising accelerometers for sensing linear motion and gyroscopes for sensing rotational rate), a magnetometer and a Global Positioning System (GPS).

In operation, the collar 100 is placed loosely over the mortar shell 200 with a forked safety plate 400 slotted on to the mortar 200 to hold the mortar 200 at the collar 100. The collar 100 may then be placed at the muzzle 310 of a barrel 300 as shown in FIG. 3*a* to prepare the mortar 100 for firing. The collar 100 is supported at the muzzle 310 by the sill 14 which rests at the lip of the muzzle 310 and is of such a form that the collar axis is generally collinear with the barrel axis. The collar 100 is also supported by the cylindrical surface 18, which fits around the muzzle 310.

In order to fire the mortar 200 the user removes the plate 400, which may be done remotely using a string. This stage in operation is shown at FIG. 3*b*.

Once the safety plate 400 is removed, the mortar 200 drops in the known manner down the barrel 300 until the pin at the base of the barrel 300 is struck and the propellant charge at the rear of the mortar is initiated.

The initiation of the propellant charge accelerates the mortar towards the muzzle 310 and the collar 100. The collar 100 remains supported at the muzzle 310 until the mortar strikes and engages with the capture surface 12. The force of the mortar striking the collar 100 at the generally frustoconical capture surface 12 sets up an interference fit between the mortar and the collar 12. This interference fit attaches the collar 100 to the mortar 200, thereby integrating the collar 100 with the mortar 200.

Further, the frustoconical form of the capture surface 12 may cooperate with the outer surface of the mortar to tend to ensure that the collar axis and the mortar axis are collinear. Thus the integrated mortar 500 is generally symmetrical.

Figure 4:
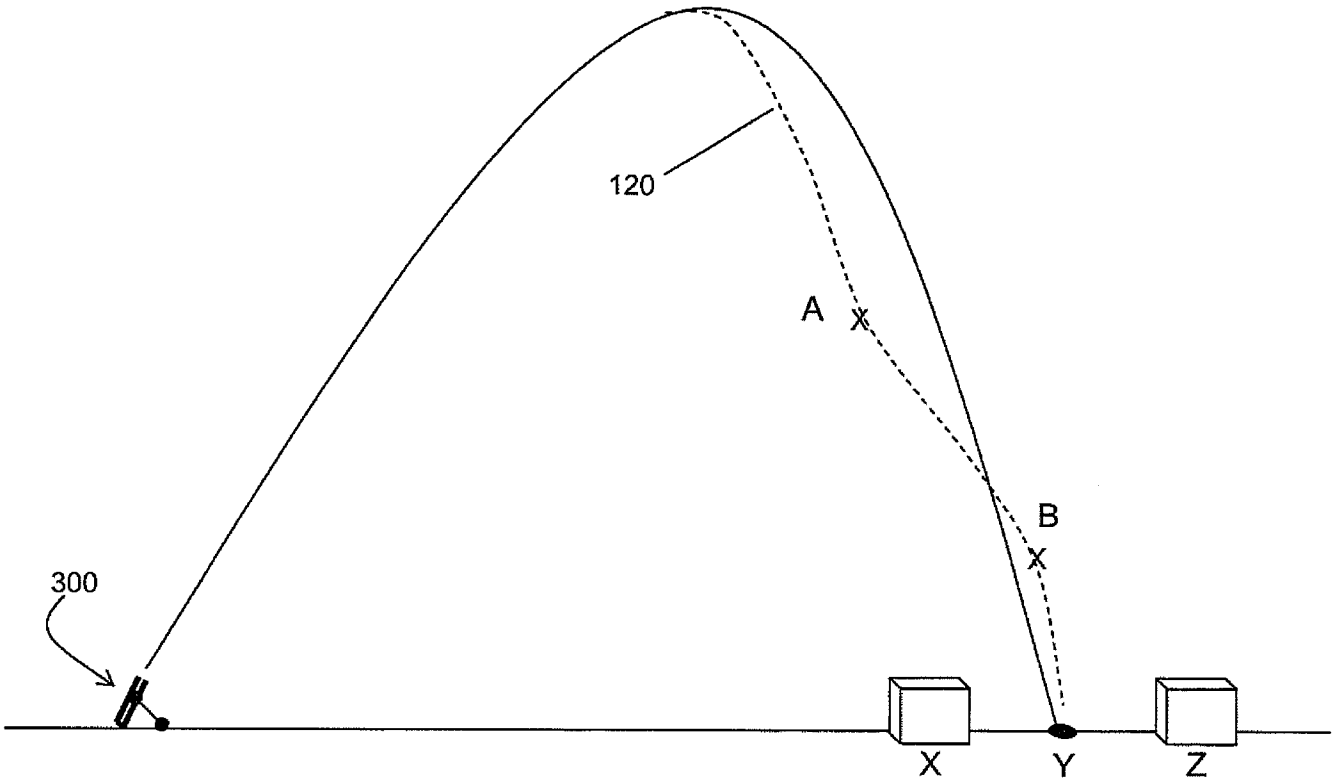
FIG. 4 represents the action of the collar of FIG. 1*a* in correcting the trajectory of a projectile at a point A and a point B.

The guidance of the integrated mortar 500 is illustrated at FIG. 4. A ballistic trajectory can be predicted from the inclination of the barrel axis and the muzzle velocity using classical mechanics, with adjustments made for air resistance made in the known way. However, a predicted ballistic trajectory may not be followed in practice because of environmental inconsistencies (such as wind) which may cause the projectile to deviate.

During its flight the collar 100 monitors its trajectory 120 using the navigational sensors in unit 54 to feed data into the processor 56. Before applying any correcting signal, the processor 56 compares the monitored trajectory 120 to a set of predicted trajectories stored in the memory 52. The processor thus determines that, of the possible predicted trajectories which the projectile 500 may follow, projectile 500 is intended to follow a particular predicted trajectory 110. By making this determination in the early part of its flight, which is the part of its flight where the weather may have least effect on the trajectory, the selection of the predicted trajectory should tend to be correct.

Once the integrated mortar 500 has determined the predicted trajectory 110, the controller 50 may regulate the actual trajectory 120 of the integrated mortar 500, attempting to conform the actual trajectory 120 to the predicted trajectory 110.

In the present embodiment, where the projectile is a free falling mortar which is not spinning in flight, the processor will rely on signals from magnetometer sensors and GPS sensors to determine the position of the projectile 500.

Inertial Navigation sensors (in particular the accelerometers) at the projectile 500 will tend to give null readings for most of the flight because, in a projectile describing pure ballistic flight, there is a net zero acceleration at a strapdown accelerometer sensing the lateral axes within the projectile (a small deceleration followed by small acceleration will be sensed in the longitudinal axis). However, in other embodiments of the collar 100, especially those where the projectile spins in flight, the IN sensors may include solid-state rate gyros and their output may be considered in determining the actual position of the projectile.

The processor 56 may, by frequently sampling the position of the projectile 500 from the signals from the sensors 54, determine the actual trajectory 120 of the projectile 500.

Once the actual trajectory 120 is determined, the processor 56 can compare the actual trajectory 120 to the predicted trajectory 110. At the point A of FIGS. 4 and 5, the processor 56 determines that the actual trajectory 120 differs from the predicted trajectory 110. In order to conform the actual trajectory 120 to the predicted 119, the processor 56 sends a correcting signal 57 to I/O unit 58. I/O unit 58 then outputs a more powerful signal to the ring actuator 40, which signal momentarily energises the ring actuator 40 so that the ring actuator 40 momentarily deflects the canard pair 20*a*, 20*b* to apply lift to the integrated mortar 500. The course of the integrated mortar should then alter and once the ring actuator is de-energised, the air flow will return the canard pair 20*a*, 20*b* to their original configuration.

In a similar manner, at the point B, the processor 56 determines that the integrated mortar 500 is now above the predicted trajectory 110 and so the correcting signal 57 is generated to energise the ring actuator 40 so that the canards deflect in the opposite direction to that at point A.

These exemplary corrective actions having been taken at the points A and B, the projectile 500 proceeds to land at the target Y, which is the predicted target for the predicted trajectory 110 and so avoids potentially sensitive targets X and Z.

For each canard pair, there are two types of corrective action which can be taken. The first type is for both canards to be deflected a specific amount in a first (glide) direction. The second type is for both canards to be deflected by the same specific amount but in a second (brake) direction. A simple control algorithm may be employed whereby the frequency of repetition of this corrective action is proportional to the deviation of the actual trajectory 120 from the predicted trajectory 110. However, the invention alternatively contemplates the use of more sophisticated control methods which employ for example PID control algorithms.

The collar body 10 may be made from milled aluminium or an alloy of aluminium. Where the collar is for attaching to an 81 mm mortar, the first opening has a diameter of approximately 78mm and tapers at approximately 1.6° to a diameter of approximately 80 mm at the inner diameter of the annular sill 14. The outer collar body diameter is 108 mm. With such a fabrication, the capture surfaces are the surfaces of the milled aluminium form.

The remaining components would be well known to skilled men in this field. Such skilled men would for example be aware of the need to use components in the guidance controller 50 which were sufficiently robust to function under the high accelerations encountered upon firing.

In the above described embodiment, the collar 100 is for attaching to and guiding a mortar round and in particular an 81 mm mortar round. However, the skilled man would realise that the invention could be applied to other calibres of mortar and indeed, other types of projectile.

The invention claimed is:

1. A guidance device for guiding the trajectory of a projectile during flight, the device comprising:

a collar having a collar body configured to be located at a muzzle of a projectile barrel prior to launch and having an internal profile which cooperates with an outer surface of the projectile when the projectile is launched through the muzzle so that the collar is attached to the projectile during flight;

the collar having guidance means comprising at least one adjustable control surface for controlling the trajectory of the projectile during flight, adjustment of said control surface being responsive to guidance signals received from a guidance control.

2. A guidance device as claimed in claim 1, wherein the internal profile of the collar is configured to engage with a rim of the projectile barrel so that the collar is located in position to cooperate with the projectile on launch.

3. A guidance device as claimed in claim 1, wherein said at least one guidance surface is pivotally mounted to the collar to allow adjustment of said surface relative to the collar.

4. A guidance device as claimed in claim 1, comprising an actuator for adjusting the control surface in response to said guidance signals.

5. A guidance device as claimed in claim 1, wherein the guidance control comprise at least one sensor for sensing a trajectory of the projectile during flight, and a processor for comparing the sensed trajectory with a predicted trajectory and outputting guidance signals for correcting the trajectory of the projectile so that it corresponds with the predicted trajectory.

6. A guidance device as claimed in claim 5, wherein the guidance control comprises a memory for a storing the predicted trajectory of the projectile.

7. A guidance device as claimed in claim 6, wherein the at least one sensor is configured for determining the trajectory of the projectile during an initial period after launch and outputting said determined trajectory for storing by the memory as the predicted trajectory.

8. A guidance device as claimed in claim 1, wherein said at least one control surface comprises a pair of canards, each canard comprising a pivot joint connecting the canard to the collar body, wherein the actuator is a ring actuator which connects to the canards so as to be able to alter the configuration of the control surface by rotating the canards about their pivots.

9. A guidance device as claimed in claim 8, wherein the pivot joint connecting each of the canards to the collar body, is connected forwards of the centre of pressure of the canard.

10. A guidance device as claimed in claim 9, wherein each canard is connected to the ring actuator at a point on the canard towards or at the trailing edge of the canard.

11. A guidance device as claimed in claim 1, wherein the internal profile of the collar body comprises a surface which tapers outwardly towards a trailing edge for forming an interference fit with the projectile thereby attaching the device to the projectile.

12. A guidance device as claimed in claim 1, wherein the internal profile of the collar body comprises a sill which supports collar on the rim of the projectile barrel so that the axis defined by the internal profile is generally collinear with the axis defined by the barrel.

13. A projectile launch and guidance system, comprising:

a projectile;

a projectile barrel for launching the projectile; and a guidance device for guiding the trajectory of a projectile during flight, the device comprising:

a collar having a collar body configured to be located at a muzzle of a projectile barrel prior to launch and having an internal profile which cooperates with an outer surface of the projectile when the projectile is launched through the muzzle so that the collar is attached to the projectile during flight;

the collar having guidance means comprising at least one adjustable control surface for controlling the trajectory of the projectile during flight, adjustment of said control surface being responsive to guidance signals received from a guidance control.

14. A method of guiding a passive projectile, the method comprising:

locating a guidance device comprising a collar at a muzzle of a projectile barrel;

launching a projectile from the barrel;

engaging an internal profile of the collar with an external surface of the projectile when the projectile is launched through the muzzle so that the collar is attached to the projectile during flight;

the collar having guidance means comprising at least one adjustable control surface for controlling the trajectory of the projectile during flight, the method further comprising adjusting said control surface in response to guidance signals for correcting the trajectory of the projectile.

* * * * *